US005099178A

United States Patent [19]

Bozzer et al.

[11] Patent Number: 5,099,178

[45] Date of Patent: Mar. 24, 1992

[54] METHOD AND SYSTEM FOR CONTROLLING THE BRIGHTNESS OF A VACUUM FLUORESCENT DISPLAY

[75] Inventors: Erich Bozzer, Dearborn Heights; James M. Raffa, Rochester; Thomas G. Burke, Royal Oak, all of Mich.

[73] Assignee: Ford Motor Company, Dearborn, Mich.

[21] Appl. No.: 569,334

[22] Filed: Aug. 20, 1990

[51] Int. Cl.[5] ..... G09G 3/10

[52] U.S. Cl. ..... 315/169.1; 315/169.3; 315/97; 315/105

[58] Field of Search ..... 315/169.1, 97, 105, 315/169.3

[56] References Cited

U.S. PATENT DOCUMENTS

| | | | |
|---|---|---|---|
| 4,158,794 | 6/1979 | Sandler | 315/169.1 |
| 4,388,558 | 6/1983 | Mizuno et al. | 315/77 |
| 4,495,445 | 1/1985 | Turney | 315/169.1 |
| 4,719,389 | 1/1988 | Miesterfeld | 315/169.1 |
| 4,791,337 | 12/1988 | Murata | 315/169.1 |
| 4,859,912 | 8/1989 | Lippmann et al. | 315/169.3 |

*Primary Examiner*—Eugene R. Laroche
*Assistant Examiner*—Tan Dinh
*Attorney, Agent, or Firm*—Paul K. Godwin, Jr.; Roger L. May

[57] ABSTRACT

A method and system for providing a wide range of variable brightness levels for a vacuum fluorescent (VF) display by changing the duty cycle of the driving signal beyond the limits of normal driving techniques by varying the frequency as well as the on-time of the driving signal. The driving signal is multiplexed by a programmed driver microcomputer to drive a plurality of grids. Consequently, by varying the frequency, the multiplex period is also varied. The driver microcomputer communicates with a host microcomputer as well as drivers and grids of the VF display to control the VF display. In addition, the driver microcomputer samples a VF filament signal to synchronize the VF display multiplex frequency with the frequency of the VF filament signal to reduce flicker at low display brightness levels. The method and system achieve a continuously variable appearance of the VF display from full bright to barely discernable.

9 Claims, 6 Drawing Sheets

$f_o$
100%-50%
$f_o/2$
50%-25%
$f_o/4$
25%-12.5%

METHOD AND SYSTEM FOR CONTROLLING THE BRIGHTNESS OF A VACUUM FLUORESCENT DISPLAY

CROSS-REFERENCE TO RELATED APPLICATION

This application is generally related to copending application Ser. No. 253,459 filed Oct. 5, 1988 entitled "Electronic Dimmer Control for Vacuum Fluorescent Display Devices" now U.S. Pat. No. 4,968,917 and having a common assignee as the present application.

1. Technical Field

This invention relates to methods and systems for controlling the brightness of a vacuum fluorescent display, and, in particular, the method and systems for providing a wide range of variable brightness for such displays by changing the duty cycle of the driving signal.

2. Background Art

Many vacuum fluorescent electronic instrument cluster systems consists of the following two sections:

1) the information processing and controlling section (host microcomputer); and
2) the VF display driver section (display driver microcomputer).

The host microcomputer gathers and processes information and communicates that information to the display driver. The display driver handles the interface to the VF display.

A VF display consists of a filament (hot cathode), grids, and anodes. A display segment appears lit when electrons emitted from the filament, pass through its associated grid and strike its corresponding anode causing the phosphor on the anode to glow.

The filament is a thin wire that, when heated by a current, provides a source of electrons. This current is AC on large displays to ensure even brightness across the display. The anodes, by being more positively charged than the filament, attract the electrons necessary to make the phosphor glow. The grid is between the filament and the anode and is used to regulate the flow of electrons from the filament to the anode. The grid controls electron flow by controlling the field between the cathode and the anode such that either many or no electrons leave the filament and continue on to the anode. In order for a display segment to appear lit BOTH the anode and the grid for that anode must be on. If either the grid or the anode is off the segment will be off.

A latch driver for providing anode data may comprise a two section device consisting of an input shift register and an output latch. Data that is in the output latch section is independent of data in the input shift register section. Control signals allow data to be transferred from the input shift register to the output latch. Any data in the output latch is applied to the anodes of the VF tube. Each output of the latch may be connected to many VF tube segments. The segment that is currently being addressed depends on which grid is on.

The VF tubes in an electric instrument cluster are often designed to operate under a 4:1 multiplex scheme (i.e. four VF tube segments). This means that a multiplex period (TM) is broken into 4 parts called grid periods (TG). A complete set of data is sent to the VF tube each multiplex period with 25% of the data being sent during each of the 4 grid periods. Anode data that is under control of a specific grid as active (on or off depending on the actual anode data during that grid's ON time.

In order to produce a display, the following sequence typically takes place:

Anode data for the next grid is shifted into the input shift register section of the latch driver while the data in the output latch section is being applied to the anodes. When the current grid period expires, ALL grids are turned off for a period of time (inter-grid blank time, IGB) and then the anode data from the input shift register is transferred to the output latch and the next grid is turned on. While this grid is "on", anode data for the next grid is shifted into the input shift register and the entire process repeats itself.

Once all grids are off, they must stay off for the inter-grid blank time, IGB. The IGB time is required to avoid having more than one grid on at a time. Since the grid voltage cannot be turned off instantaneously, there is a fall time associated with it. The IGB time must be long enough to encompass the fall time to insure that the previous grid is completely off before the next grid is turned on. When the IGB time has expired the next grid is turned on.

Display brightness is related to the potential difference (DC voltage) between the filament and the anode, and the grid on-time. The larger the potential difference and the longer the grid is left on, the brighter the display.

To obtain a maximum brightness display each grid will be left on for the maximum time possible which is the grid period minus the delays. Therefore, the grid on-time (TGON)=(TG−IGB). The longer IGB is, the shorter the maximum achievable grid on-time becomes.

Display brightness is varied by varying TGON. as TGON becomes shorter the display brightness becomes dimmer. (The shortest grid on-time achievable depends on the speed of the microcomputer and any propagation delays in the circuitry.

A changing or flickering brightness problem develops when the grid on-time becomes smaller than the period of the AC filament signal (TGON<TF). The grid will be on only during a portion of the filament signal, and since the filament signal is asynchronous to the grid signal, the display brightness will fluctuate.

Most conventional display systems cannot use TGON values that are smaller than TF without flickering and this limits their ability to produce a very dim display which is continuously variable down to the point of barely discernable.

U.S. Pat. No. 4,859,912 discloses a brightness control circuit which overcomes part of this problem. A feedback signal from the power supply that generates the AC filament signal is used as an input to a microcomputer. The microcomputer uses this signal to synchronize turning on the anode with the filament signal.

U.S. Pat. No. 4,158,794 discloses a VF display control system which maintains substantially constant illumination across the display by controlling power to the cathode filament in response to driven and undriven states of the control grids.

U.S. Pat. No. 4,495,445 discloses a VF display control system which produces uniform brightness by applying a control signal which is in phase with the AC voltage applied to the cathode/filament of the display.

U.S. Pat. No. 4,719,389 discloses a VF display control system which uses a microcomputer to synchronize filament voltage with grid voltage to maintain a flicker-free display.

Other U.S. patents which disclose VF display control systems generally of the type to which this invention relates include U.S. Pat. Nos. 4,791,337 and 4,388,558.

SUMMARY OF THE INVENTION

An object of the present invention is to provide a method and system for controlling the brightness of a vacuum fluorescent (VF) display by varying the frequency as well as the "on-time" of a signal which drives the VF display in order to provide a VF display which is dimmer than prior displays, yet still accurately controls the brightness of the display.

Another object of the present invention is to provide a method and system for controlling the brightness of the VF display by varying the frequency as well as the "on-time" of a signal which drives the VF display in a reliable, accurate, and cost efficient fashion so that a greater range of display brightness variability (i.e. dimming ratio) is possible.

In carrying out the above objects and other objects of the present invention, a method for controlling the brightness of a vacuum fluorescent (VF) display is provided. The display includes anodes, grids, and a filament. The method includes the steps of supplying an alternating current signal to the filament and generating control pulses for enabling display illumination. The control pulses have an "on-time" and an "off-time" and a nominal frequency. The method further includes the step of controlling the duty cycle of the control pulses to control display brightness. The step of controlling includes the steps of modifying the on-time of the control pulses to provide a nominal range of display brightness and modifying the nominal frequency to expand the nominal range of display brightness.

Preferably, the method further includes the step of coordinating the alternating current signal with the control pulses to obtain uniform perceived display brightness.

Further, in carrying out the above objects and other objects of the present invention, a system for carrying out the method is also provided.

The advantages accruing to the method and system of the present invention are numerous. For example, by varying the frequency of the drive signal (especially while maintaining synchronization with the filament signal) it is possible to produce a flicker-free continuously variable display brightness that may be dimmed down to the point of being barely discernable.

The above advantages and other advantages and features of the present invention are readily apparent from the following detailed description of the invention when taken in connection with the accompanying drawings.

BEST MODE FOR CARRYING OUT THE INVENTION

Figure 1:
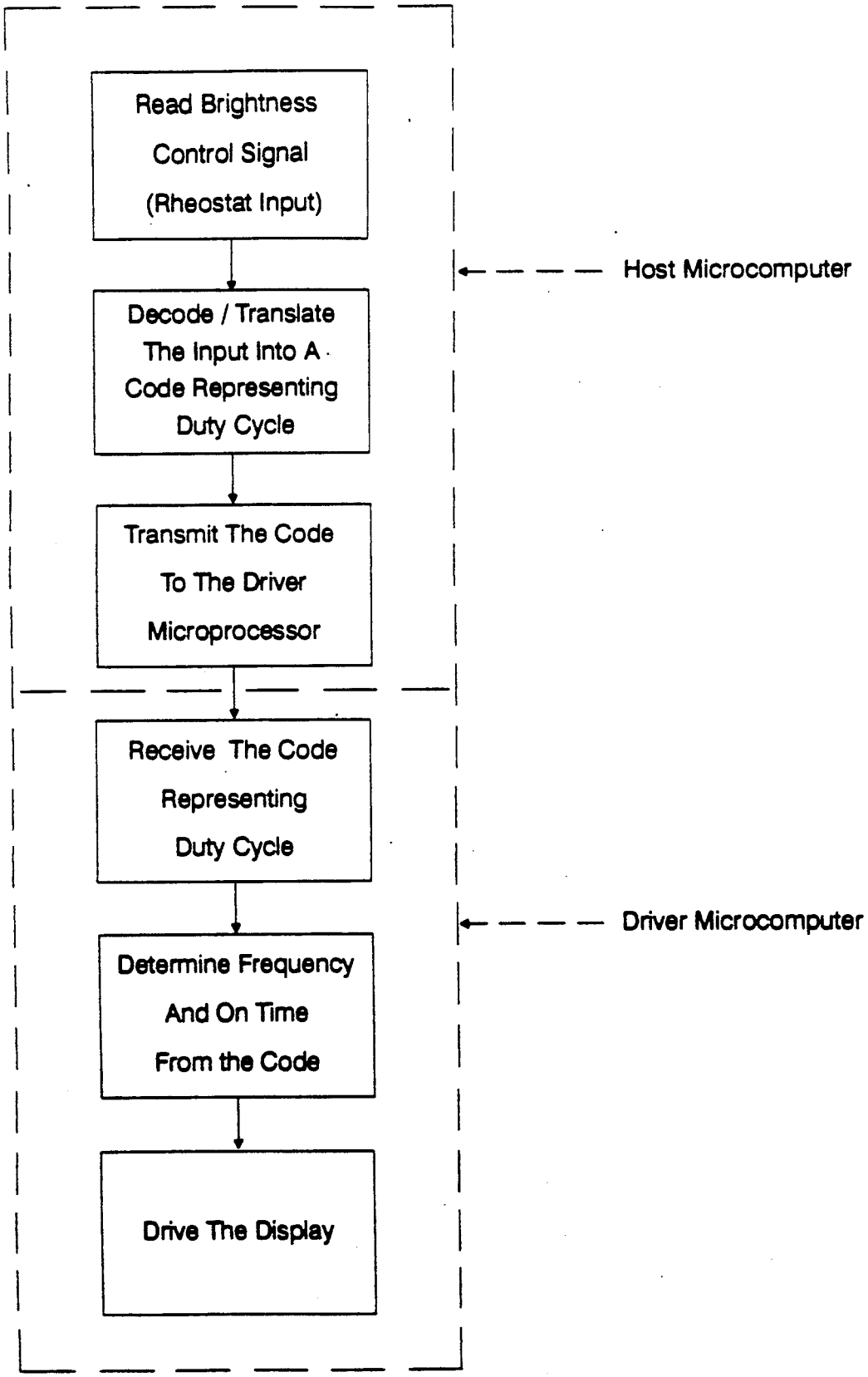
FIG. 1 is a schematic flow diagram illustrating the various steps performed by host and driver microprocessors in order to convert a rheostat position to drive signals for driving a VF display.
Figure 2:
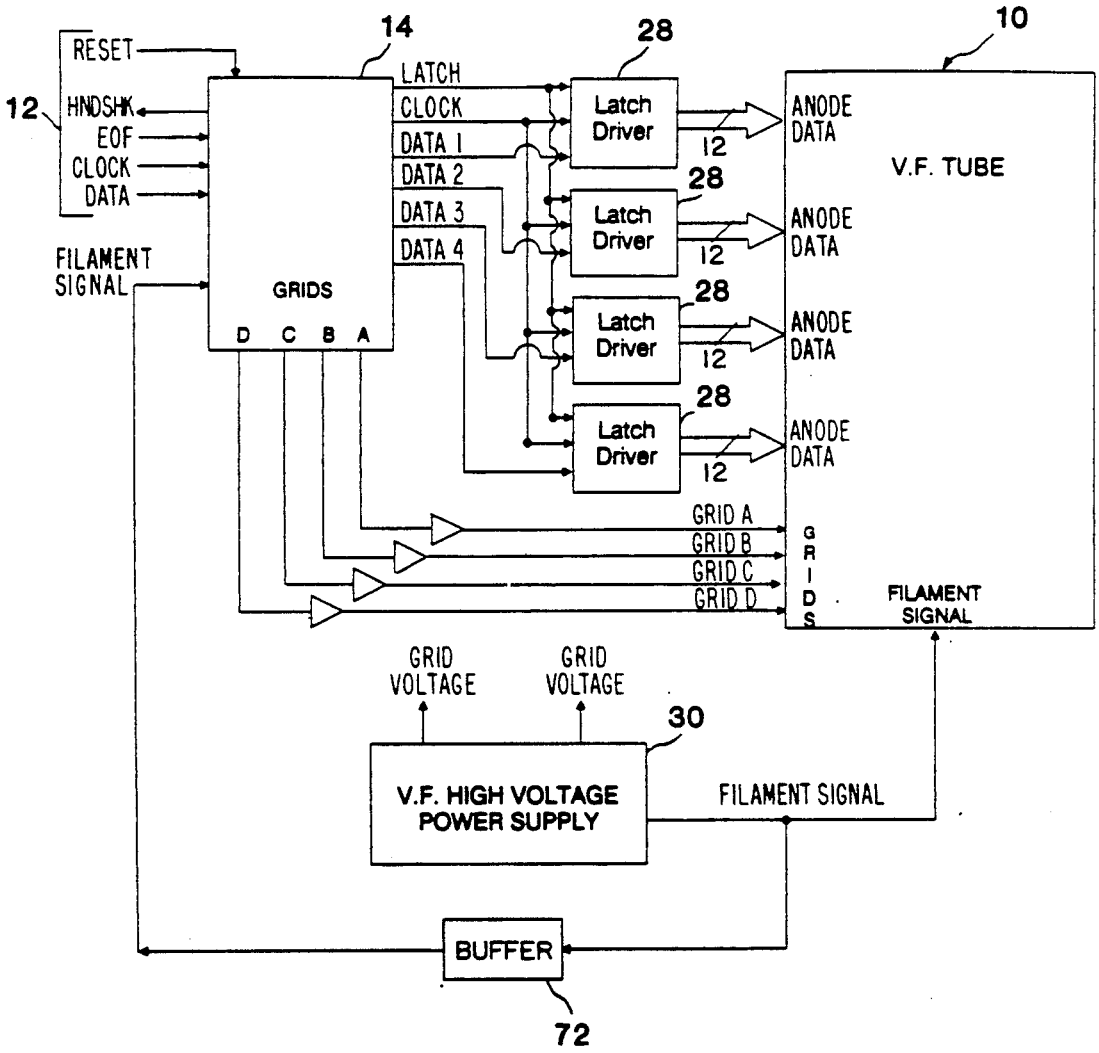
FIG. 2 is a schematic block diagram of a display drive section of the present invention.

Referring now to the drawing figures, there is illustrated in FIGS. 1 and 2 the steps taken by a host microcomputer and the steps taken by a driver microcomputer 14 in order to convert the setting of a manually controlled variable resistor or rheostat or any other type of input to drive a vacuum fluorescent (VF) display, generally indicated at 10 in FIG. 2. The VF display or tube 10 includes a filament, grids and anodes organized in a well known display arrangement suitable for multiplexing the display as is more fully described in the background art portion herein.

Convenient parameters for operating the display 10 include (1) a multiplex time slot of 1200–1320 microseconds of a grid time slot of 300–330 microseconds with 4:1 multiplexing to minimize stroboscopic effects, (2) a dimming ratio of 2600 to allow a wide control of display dimming not previously provided by the prior art and (3) a typical filament frequency of 30 kHz.

Figure 4:
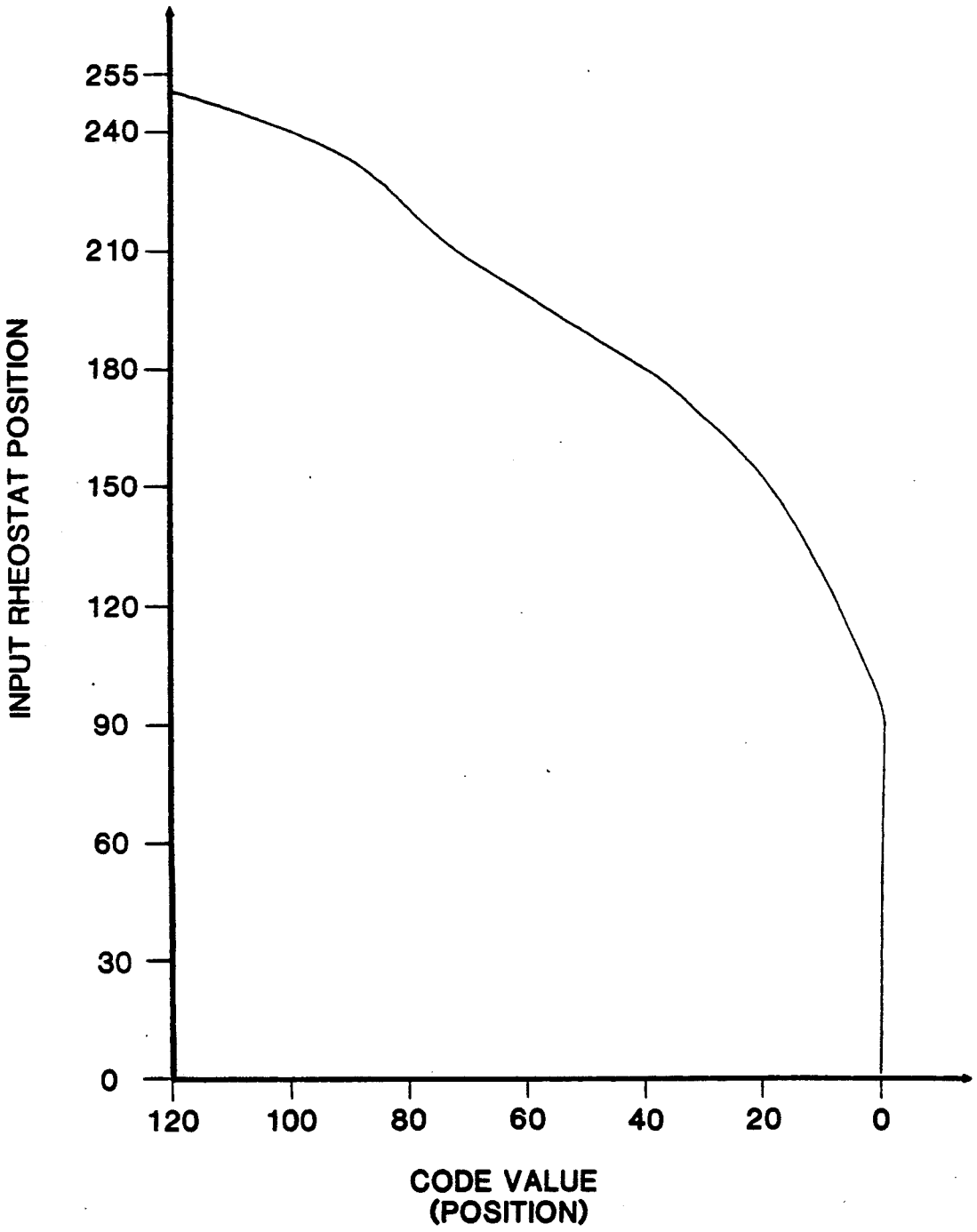
FIG. 4 is a graph correlating the input position of a rheostat with a code representing duty cycle as provided by the host microprocessor of FIG. 1.

Referring collectively to drawing FIGS. 1 and 4, the host microcomputer initially reads a brightness control signal in the form of a input rheostat position. The rheostat position is divided into 256 equally sized steps by the host using an analogue to digital converter to decode or translate the input position of the rheostat into a code representing the duty cycle that the VF display 10 is to be driven.

Finally, the host microcomputer transmits the code over a communication link or bus 12, as illustrated in FIG. 2, to the driver microcomputer 14.

The host microcomputer is identified by Model No. 68HC11 produced by Motorola and the driver microcomputer 14 by Model No. HMCS 424AC produced by Hitachi. The driver microcomputer 14 has clock rate of 4 megahertz and a 1 microsecond instruction cycle.

The bus 12 connects the host microcomputer to the driver microcomputer 14 to provide for the timing, control and data signals as indicated in FIG. 2 between the host and driver microcomputers.

Figure 5:
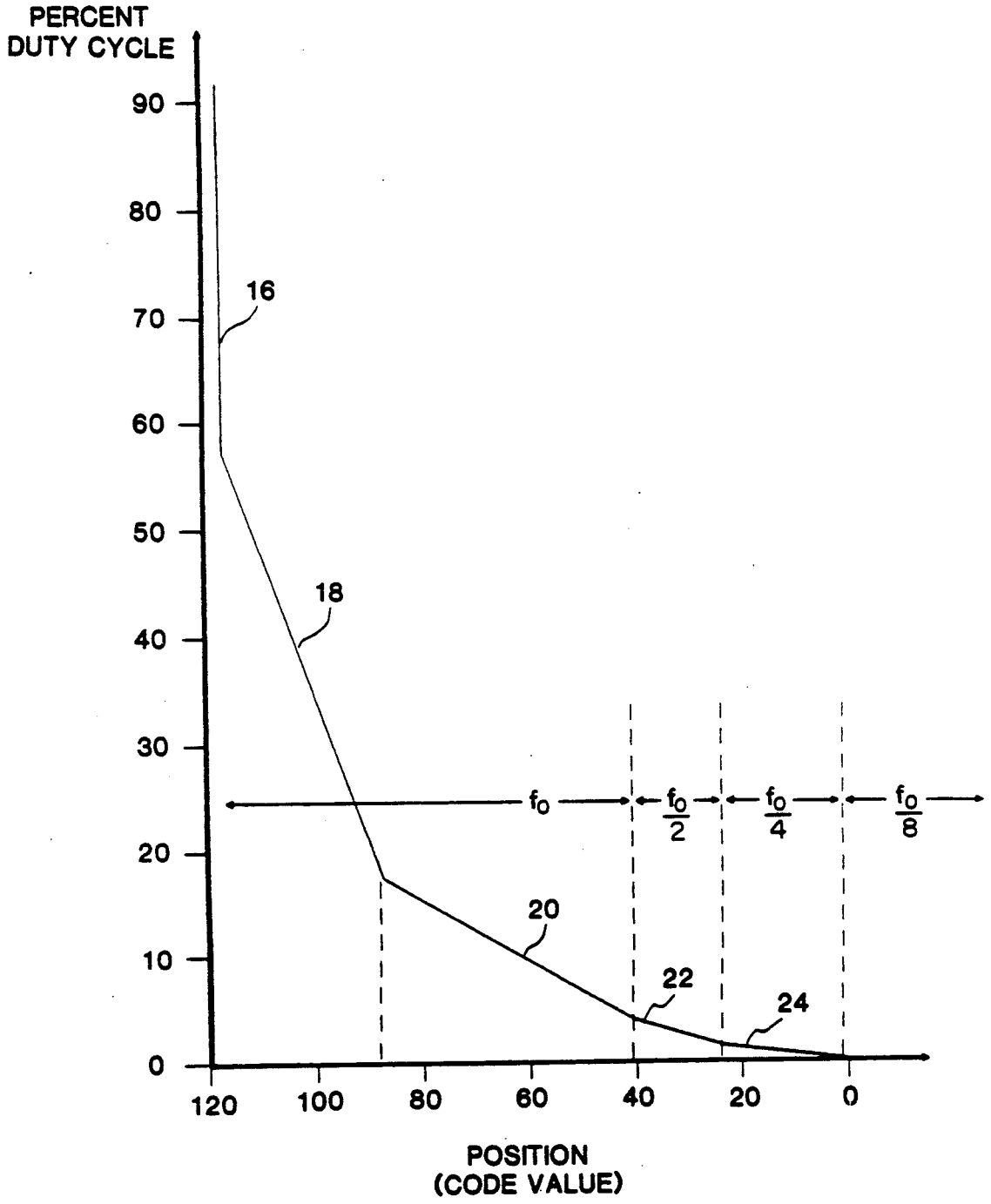
FIG. 5 is a graph correlating the code of FIG. 4 with percent duty cycle wherein pulse on-time as well as frequency of the drive signal is provided by the driver microprocessor of FIG. 1.
Figure 6:
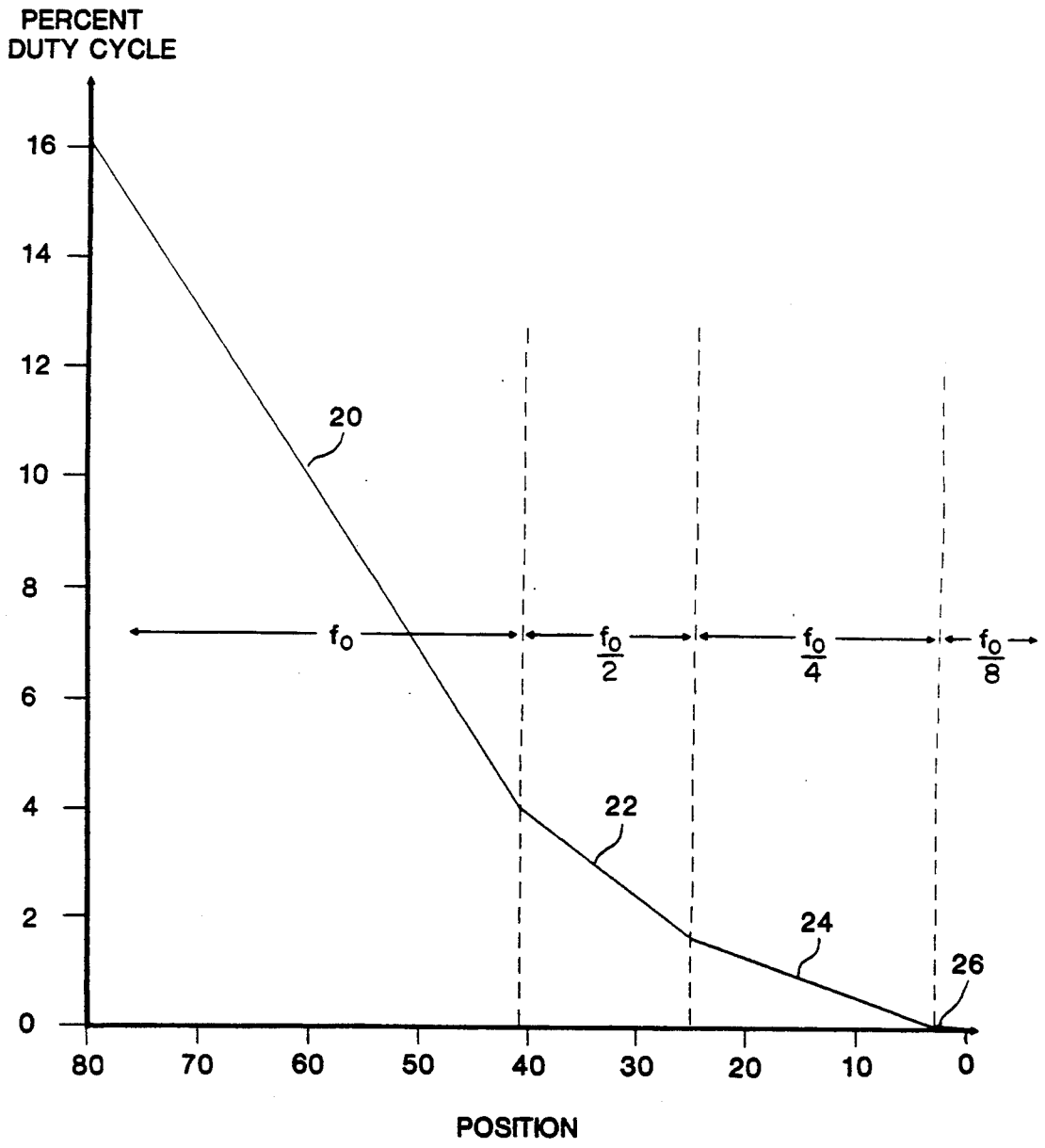
FIG. 6 is a graph enlarging the low end of the graph of FIG. 5.

Referring again to FIG. 1 in combination with FIGS. 5 and 6, the driver microcomputer 14 initially receives the code representing the duty cycle from the host microcomputer. Then, the driver microcomputer determines frequency and on-time of the multiplexed drive signal for the VF display 10 according to the graphs of FIGS. 5 and 6.

For example, if the position or code value is between 41 and 122 the duty cycle is determined from 3 straight line segments 16, 18 and 20 wherein the frequency of the multiplexed drive signal is $f_0$, the origin of which is described in greater detail below. In other words, if the code value for rheostat position is between 122 and 120, straight line segment 16 is utilized to determine percent duty cycle. Between position code value 120 and 88, straight line segment 18 is utilized. Finally, when the position code value lies between 41 and 88, straight line segment 20 to determine percent duty cycle.

FIG. 6 is a blow-up of the lower portion of the graph of FIG. 5 wherein if the position or code value is between 25 and 41, a straight line segment 22 is utilized to determine percent duty cycle at frequency $f_0/2$. In like fashion, a straight line segment 24 is utilized to determine percent duty cycle when the position or code value is between 25 and 2 at frequency, $f_0/4$. Finally, a straight line segment 26 is utilized when the code value is between 2 and 0 at frequency $f_0/8$ to determine the percent duty cycle.

The driver microcomputer 14 drives the display 10 at one of the frequencies $f_0$, $f_0/2$, $f_0/4$ or $f_0/8$ wherein the on-time of the control or drive pulses is determined by the percent duty cycle.

Conventional latch drivers 28 as described in the background art portion herein transfer data from the driver microcomputer 14 to the anodes of the VF display 10. Preferably, the output of each latch driver 28 may be connected to many VF tube segments of the VF display 10. The segment that is currently being addressed by the microcomputer 14 depends upon which grid is on.

Figures 3A, 3B, 3C:
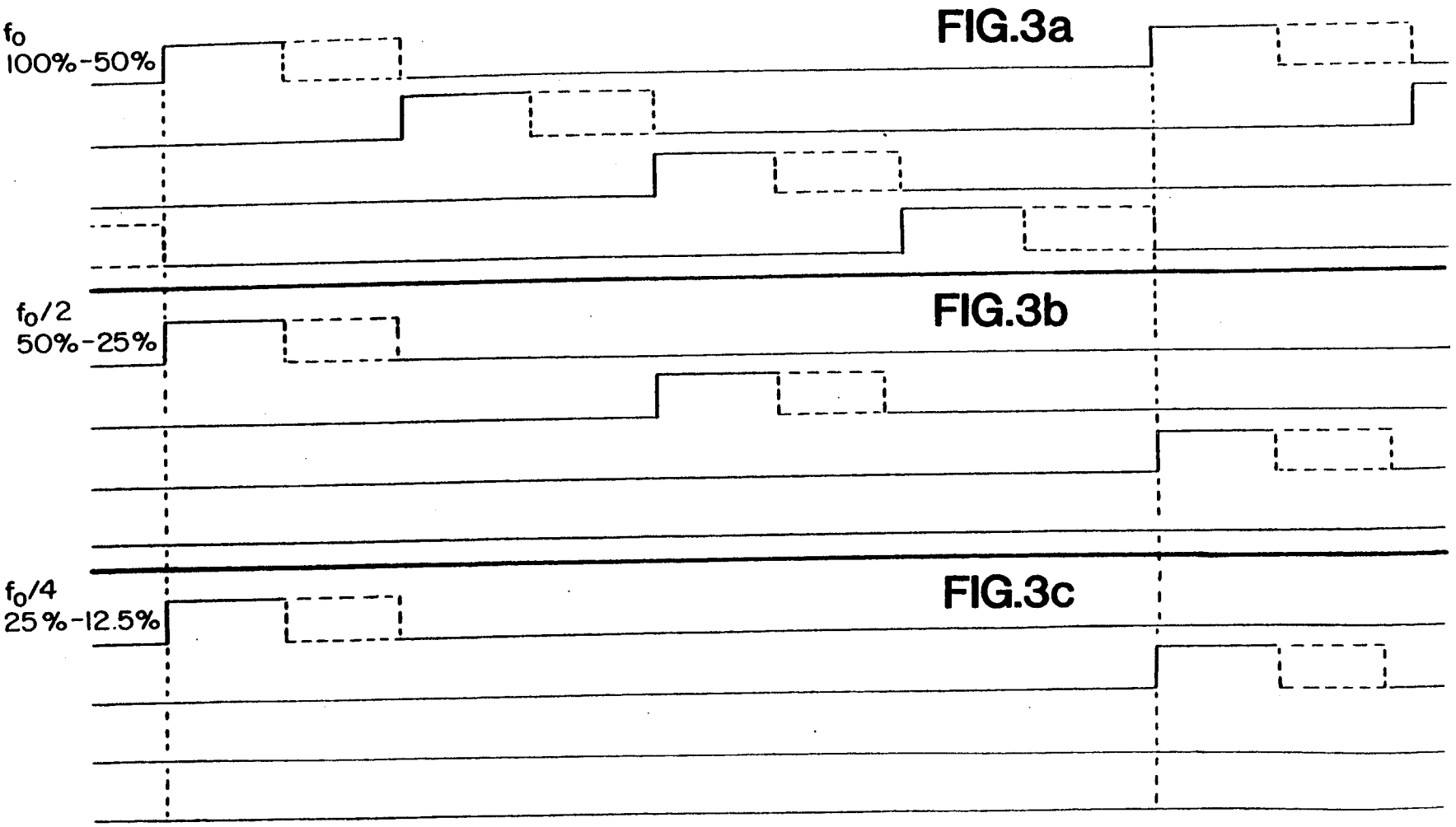
FIGS. 3*a*, 3*b* and 3*c* are diagrams illustrating multiplexed driving signals for three different frequencies.

The VF tubes of the VF display 10 preferably operate on a 4:1 multiplex scheme as indicated in FIGS. 3*a*, 3*b* and 3*c*. Consequently, the multiplex period is broken into four grid periods and a complete set of data is sent to the VF display 10 each multiplex period with 25% of the data being sent during each of four grid periods.

In order to produce a display on the VF display 10, the sequence which takes place is generally that as described in the background art portion herein.

In order to synchronize or coordinate the multiplex drive signal and the filament signal from the voltage power supply 30, the filament signal is conditioned by a buffer 72 which is fed back to the driver microcomputer 14. The driver microcomputer 14 utilizes the signal to synchronize turning on the grid with the filament signal. The grid is turned on at the same point on the filament signal each time so that a potential difference between the filament and the anode will be relatively constant, thus eliminating flicker. In particular, the driver microcomputer 14 samples the filament signal and derives the frequency $f_0$, by counting the integer number of periods of the buffered filament signal. For example, a typical $f_0$ might be 760 hz.

As previously mentioned, FIGS. 3*a*, 3*b* and 3*c* illustrate the multiplexed dimming or drive signal at frequencies $f_0$, $f_0/2$and $f_0/4$. The control pulses are indicated wherein the on-times may be extended as indicated by dotted lines to represent a higher percent duty cycle as indicated by the higher left most number in the range underneath its respective frequency down to the lower right-most duty cycle percent also indicated under the frequency. The multiplexed dimming or drive signals for the frequency $f_0/8$ are not indicated for purposes of simplicity since they follow the pattern established by the prior multiplex drive signals.

In the method and system described herein, the brightness is controlled by varying the duty cycle of the control drive signals which are illustrated as grid drive signals. However, it is to be understood that the same can be accomplished by varying the duty cycle of the anode signals or by varying the duty cycle of the cathode signal at the filament. Accordingly, any of the three electrodes, cathode, anode or grid can be used as a control element for the vacuum fluorescent tube 10.

Also, while preferable, it is not essential that a driver microprocessor such as the driver microprocessor 14 be provided since other digital logic circuits can perform the same task.

The advantages according to the use of the present invention are numerous. For example, an expanded dimming ratio of 1:2600 can be provided by controlling the duty cycle of the control pulses as illustrated in FIGS. 3*a* through 3*c* not only by modifying the on-time of the control pulses but also by modifying the nominal frequency of the multiplex drive signal.

In other words, instead of maintaining a single multiplex drive frequency such as $f_0$, the frequency of the multiplex drive signal can be varied from $f_0$ to $f_0/2$ to $f_0/4$ or to $f_0/8$ depending on the rheostat position. In this way, the duty cycle of the driving signal is varied beyond the limits of conventional driving techniques.

Obviously, the frequency of the multiplex driving signal need not be varied in a step-wise fashion but may be varied on a continuous basis to vary the duty cycle.

Also, while preferable, the method and system of the present invention do not require synchronization of the filament signal with the multiplex drive signal. For example, if for some reason the buffer filament signal is not available to the driver microcomputer 14, a previously stored value of $f_0$ may be utilized by the driver microcomputer 14 to vary the frequency and consequently the duty cycle of the multiplex drive signal.

The invention has been described in an illustrative manner and, it is to be understood that, the terminology which has been used is intended to be in the nature of words of description rather than of limitation. Many modifications and variations of the present invention are possible in light of the above teachings.

It is, therefore, to be understood that, within the scope of the appended claims, the invention may be practiced otherwise than as specifically described

We claim:

1. A method for controlling the brightness of a vacuum fluorescent (VF) display, the display including anodes, grids and a filament, the method comprising the steps of:

supplying an alternating current signal to the filament;

generating control pulses for enabling display illumination, the control pulses having an on-time and an off-time and having a nominal frequency; and controlling the duty cycle of the control pulses to control display brightness, wherein the step of controlling includes the steps of modifying the on-time of the control pulses to provide a nominal range of display brightness and modifying the nominal frequency to expand the nominal range of display brightness.

2. The method as claimed in claim 1 further comprising the step of coordinating the alternating current signal with the control pulses to obtain uniform perceived display brightness.

3. The method as claimed in claim 2 wherein the step of coordinating includes the step of supplying a feedback signal corresponding to the alternating current signal to modify the nominal frequency.

4. The method as claimed in claim 1 or claim 2 wherein the nominal frequency is derived from the alternating current signal.

5. The method as claimed in claim 1 wherein the control pulses are successively supplied to the grids.

6. A control system for a vacuum fluorescent (VF) display having anodes, grids and a filament, the system comprising:

means for supplying an alternating current signal to the filament;

means for generating control pulses for enabling display illumination wherein the control pulses have an on-time and off-time and a nominal frequency;

control means for controlling the duty cycle of the control pulses to control display brightness, by modifying the on-time of the control pulses to provide a nominal range of display brightness and by modifying the nominal frequency of the control pulses to expand the nominal range of display brightness.

7. The system as claimed in claim 6 further comprising means for coordinating the alternating current signal with the control pulses to obtain uniform perceived display brightness.

8. The system as claimed in claim 7 wherein said means for coordinating includes feedback means for supplying a feedback signal corresponding to the alternating current signal to the control means.

9. The system as claimed in claim 6 further comprising multiplexing means for successively supplying the control pulses to the grids.

* * * * *